US005742881A

United States Patent [19]

McTigue

[11] Patent Number: 5,742,881

[45] Date of Patent: Apr. 21, 1998

[54] OCCLUDER WITH INTEGRAL ILLUMINATION SOURCE

[75] Inventor: Daniel J. McTigue, Fairport, N.Y.

[73] Assignee: Xerox Corporation, Stamford, Conn.

[21] Appl. No.: 719,054

[22] Filed: Sep. 24, 1996

[51] Int. Cl.[6] ..... G03G 15/36

[52] U.S. Cl. ..... 399/194; 399/183

[58] Field of Search ..... 399/6, 183, 194; 355/40

[56] References Cited

U.S. PATENT DOCUMENTS

| | | | |
|---|---|---|---|
| 4,712,907 | 12/1987 | Weinberger et al. | 355/7 |
| 4,806,976 | 2/1989 | Kato et al. | 355/7 |
| 4,963,920 | 10/1990 | Fukushima | 355/40 |
| 5,021,832 | 6/1991 | Fukushima | 355/218 |
| 5,521,675 | 5/1996 | Poplawski et al. | 355/202 |

*Primary Examiner*—William J. Royer
*Assistant Examiner*—Quana Grainger
*Attorney, Agent, or Firm*—John S. Wagley

[57] ABSTRACT

An annotation system for automatically recording additional image information on an image bearing member is provided. The system includes an occluding device assembly, including an occluder bar for masking the image bearing member in a predetermined region to allow for the additional image information to be recorded thereon, a light emitting source for producing a light image of the additional image information, and a drive apparatus for simultaneously selectively positioning the occluder bar and the light emitting source with respect to an image area on the image bearing member.

6 Claims, 5 Drawing Sheets

OCCLUDER WITH INTEGRAL ILLUMINATION SOURCE

This invention relates to electrostatographic printing machines, and, more particularly, to an electrostatographic printing system having a light lens exposure station.

Generally, the process of electrostatographic reproduction is executed by exposing a light image of an original document to a substantially uniform charged photoreceptive member. Exposing the charged photoreceptive member to a light image discharges the photoconductive surface thereof in areas corresponding to non-image areas in the original document while maintaining the charge on the image areas to create an electrostatic latent image of the original document on the photoconductive surface of the photoreceptive member. The latent image is subsequently developed into a visible image by depositing a charged developing material onto the photoconductive surface so that the developing material is attracted to the charged image areas thereon. The developing material is then transferred from the photoreceptive member to an output copy sheet on which the image may be permanently affixed in order to provide a reproduction of the original document. In a final step in the process, the photoreceptive member is cleaned to remove any residual developing material on the photoconductive surface thereof in preparation for successive imaging cycles.

The electrostatographic copying process described above is well known and is commonly used for light lens copying of an original document. Analogous processes also exist in other electrostatographic printing applications such as, for example, ionographic printing and reproduction, where charge is deposited on a charge retentive surface in response to electronically generated or stored images.

Over the years, numerous and various efforts have been made to improve and enhance the customer features found in high speed electrophotographic printing machines. Among these efforts, there has been an attempt to provide a reliable system for automatically annotating or serially marking the documents produced in the electrophotographic process, such as pagination of output sheets and the like. Such efforts have generally been directed toward a system which prevents the discharging of a selected local area in the image area on the photoreceptor corresponding to each document, and thereafter discharging a portion of the selected local area via a light pattern in the form of one of a sequence of alphanumeric characters.

The following disclosures may be relevant to various aspects of the present invention:

U.S. Pat. No. 5,521,675

Patentee: Poplawski et al.

Issued: May 28, 1996

U.S. Pat. No. 5,021,832

Patentee: Fukushima

Issued: Jun. 4, 1991

U.S. Pat. No. 4,963,920

Patentee: Fukushima

Issued: Oct. 16, 1990

U.S. Pat. No. 4,806,976

Patentee: Kato et al.

Issued: Feb., 21 1989

U.S. Pat. No. 4,712,907

Patentee: Weinberger et al.

Issued: Dec. 15, 1987

The relevant portions of the foregoing disclosures may be briefly summarized as follows:

U.S. Pat. No. 5,521,675 to Poplawski et al., assigned to Xerox Corporation, discloses an annotation system for automatically recording additional image information on an image bearing member such as a photoconductive member in an electrostatographic printing machine. The annotation system includes an occluding device assembly having an occluder bar for masking the image bearing member in a predetermined region to allow for the additional image information to be recorded thereon and a drive apparatus for selectively positioning the occluder bar with respect to an image area on the image bearing member, wherein a system is provided for releasably mounting the occluder bar to the drive apparatus. The system also includes a light emitting source for producing a light image of the additional image information on the masked region of the image bearing member.

U.S. Pat. No. 5,021,832 to Fukushima discloses an electrophotographic copier comprising an optical system for projecting an original image onto a photoreceptor to form an electronic latent image thereon and a movable LED array for forming an electrostatic latent image corresponding to additional information on the photoreceptor. A seal is applied to a bottom face of an original supporting glass table for retaining electric charge on a selected region of the photoreceptor by partially intercepting the original image projected by the optical system. The LED array is switchable between a mode for recording the additional information on the selected region of the photoreceptor, and a mode for erasing the charge in the selected region.

U.S. Pat. No. 4,963,920 to Fukushima discloses an copying apparatus for imprinting page data and the image of an original document onto a copy sheet. The copying apparatus includes a counting device for counting the number of original documents, a selecting device for selecting the mode for imprinting the page data on the copy sheet using page data imprinting controlling device, and a device for canceling a selected page data imprinting mode or inoperative condition when the apparatus is under a state where the page data imprinting cannot be completed.

U.S. Pat. No. 4,806,976 to Kato et al. discloses a copying apparatus having the capability to write optional pattern information on a copy sheet. The apparatus comprises an original glass plate, a photosensitive drum, plural devices for forming a copied image of the original document on the photosensitive drum, an editor for inputting arbitrary coordinate data, an eraser including an LED array, a control circuit for controlling the eraser in accordance with input date, and a transfer device for transferring the copied image and the pattern image on the same surface of a copy sheet.

U.S. Pat. No. 4,712,907 to Weinberger et al. discloses an electrophotographic printing machine for reproducing an original document with a copy thereof having additional indicia thereon. A means such as a movable "occluder bar" is used to mask a region of photoconductive member from the illuminating means to prevent discharge at that region. Then a means to discharge selectively the masked region records a latent image corresponding to the additional indicia.

Customers of light lens copy machine have discovered the need to place either on the top or bottom of the page, titles and/or numbers of pages to be copied. These numbers have in the past been added by a Bates stamp or similar method subsequent to copying for recording the copies in a sequential order. This is particularly important in complex litigation matters where documents need to be copied and serialized.

Different light lens copy machine customers have found it advantageous to locate the titles and/or numbers either on the top or bottom of the page that is copied. Also, the copy document may be copied onto pages of different size, for example, A4, 8½ by 11, or legal size paper. The titles and/or numbers are typically added by a print bar having a length of approximately one-half inch, for example, through the use of a LED bar. For top edge registration systems, a common LED bar may be placed near the top edge of the copy providing for a placement of numbers or titles near the top edge of the document for any of several various sizes of documents.

However, in a top edge registration system it may be advantageous to add the title and number to the bottom of the page or conversely for a bottom edge registration system it may become advantageous to locate the information on the top edge of the copy. In these cases additional LED bars are required.

Further, an additional bar is required for each particular length or size of paper to be used. Say, for example, to merely enable the use of 8½×11 as well as 8½×14 inch paper, a minimum of three LED bars are required. An alternative to this is to place an LED printbar going the full length of the photoreceptor whereby the print information may be placed anywhere along the document. The use of second and subsequent LED bars adds significant cost to the paginating system of the copier. Further, the alternative use of a full length LED bar adds even greater cost to the paginating system.

In accordance with one aspect of the invention, there is provided an annotation system for automatically recording additional image information on an image bearing member. The system includes an occluding device assembly, including an occluder bar for masking the image bearing member in a predetermined region to allow for the additional image information to be recorded thereon, a light emitting source for producing a light image of the additional image information, and a drive apparatus for simultaneously selectively positioning the occluder bar and the light emitting source with respect to an image area on the image bearing member.

In accordance with another aspect of the present invention, there is provided an electrostatographic printing machine for reproducing a copy of an original document, the copy including additional image information thereon. The machine includes a photoconductive member and a charger for charging at least a portion of said photoconductive member to a substantially uniform potential. The machine also includes an illuminator for selectively illuminating the charged portion of the photoconductive member to selectively discharge the charged portion of the photoconductive member such that an electrostatic latent image corresponding substantially to the original document being reproduced is recorded thereon. The machine also includes an annotation system for automatically recording additional image information on the photoconductive member. The system includes an occluding device assembly, having an occluder bar for masking the image bearing member in a predetermined region to allow for the additional image information to be recorded thereon, a light emitting source for producing a light image of the additional image information, and a drive apparatus for simultaneously selectively positioning the occluder bar and the light emitting source with respect to an image area on the image bearing member.

In accordance with yet another aspect of the present invention an electrophotographic printing machine for reproducing an original document with a copy thereof having additional indicia thereon is provided. The machine includes a photoconductive member and a charger for charging at least a portion of the photoconductive member to a substantially uniform charge. The machine also includes an illuminator for selectively illuminating the charged portion of the photoconductive member to discharge selectively the charged portion of the photoconductive member to record an electrostatic latent image on the photoconductive member corresponding substantially to the original document being reproduced. The machine further includes a mask for masking a region of the charged portion of the photoconductive member discharged normally by the illuminator to prevent the discharge thereof by the illuminator. The machine also includes a discharger for discharging selectively the masked region of the charged portion of the photoconductive member to record an electrostatic latent image thereon corresponding to the additional indicia and a positioner for simultaneously positioning the mask and the discharger relative to the photoconductive member.

For a general understanding of the present invention, as well as other aspects thereof, reference is made to the following description and drawings, in which like reference numerals are used to refer to like elements, and wherein.

Figure 1:
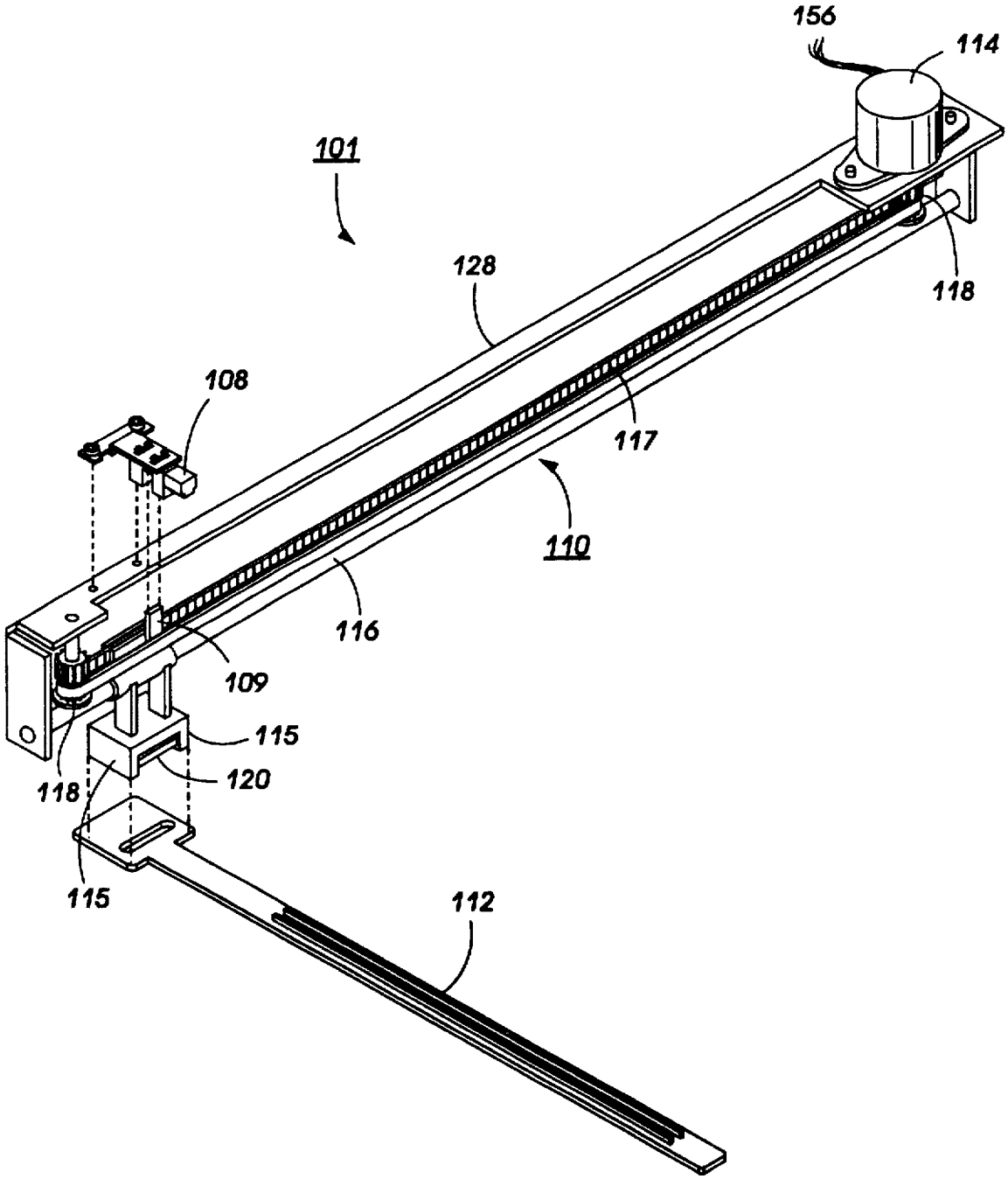
FIG. 1 is an exploded perspective view of an occluder bar assembly according to the present invention.

While the present invention will hereinafter be described in connection with a preferred embodiment and process, it will be understood that it is not intended to limit the invention to that embodiment or process. On the contrary, the following description is intended to cover all alternatives, modifications, and equivalents, as may be included within the spirit and scope of the invention as defined by the appended claims. Other aspects and features of the present invention will become apparent as the following description progresses.

For a general understanding of the features of the present invention, reference is made to the drawings, wherein like reference numerals have been used to identify particular elements, components and subsystems. Inasmuch as the art of electrostatographic printing and electrophotographic copying is well known, the various processing stations employed in such processing machines will initially be described briefly with reference to FIG. 5. It will become apparent from the following discussion that the occluding device of the present invention is equally well suited for use in a wide variety of electrophotographic or other electronic printing systems. It will be further understood that the present invention is not necessarily limited in its application to the particular embodiment or embodiments shown and described herein.

Figure 5:
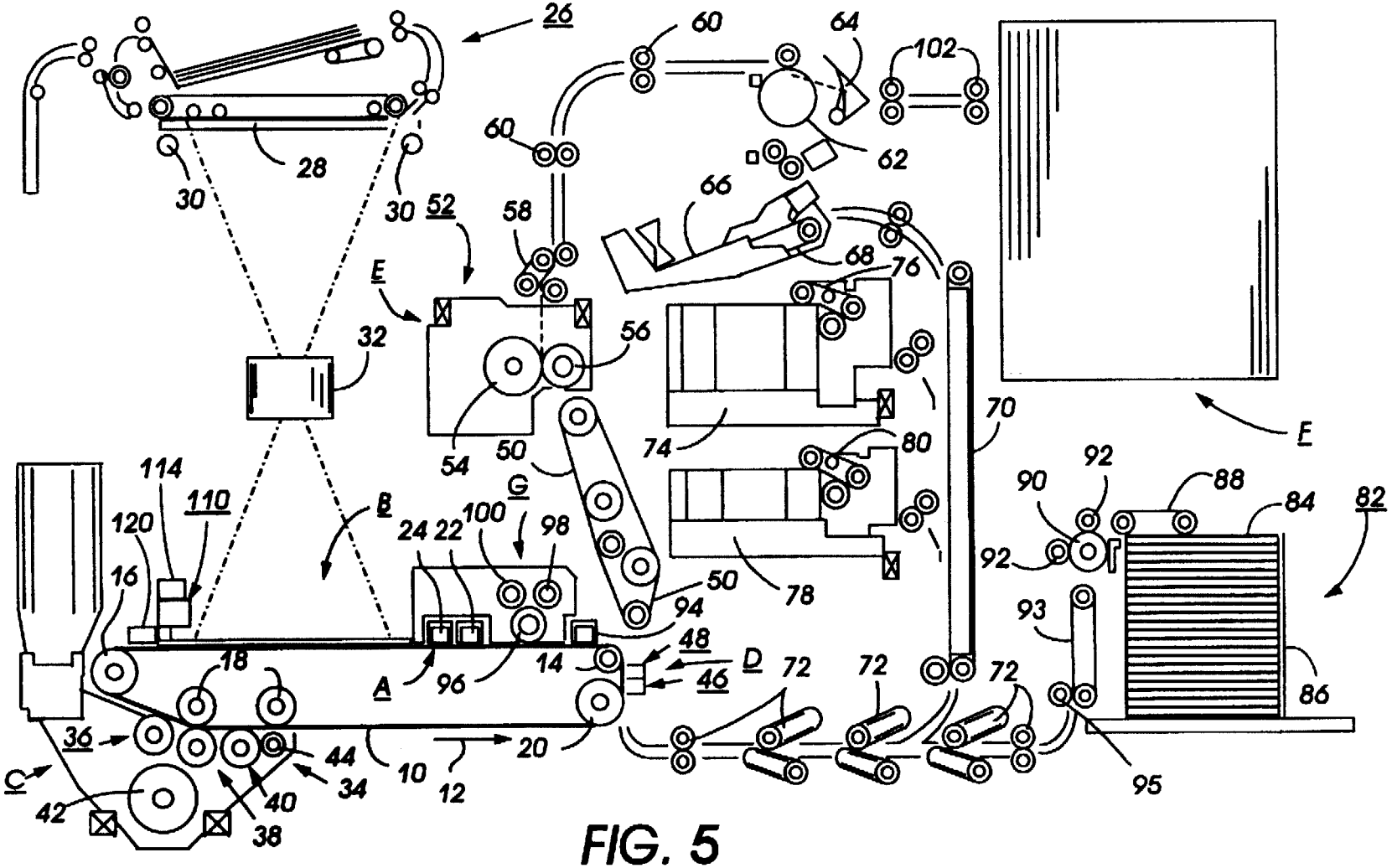
FIG. 5 is a schematic elevational view of an illustrative electrophotographic printing machine of the type which could advantageously utilize the occluder bar assembly of FIG. 1.

Turning initially to FIG. 5, prior to discussing the invention in detail, a schematic depiction of an exemplary electrophotographic reproducing machine incorporating various subsystems is furnished wherein a photoconductive belt 10 is employed, preferably comprising a photoconductive material coated on a ground layer, which, in turn, is coated on an anti-curl substrate. The photoconductive material typically includes a transport layer, which may contain molecules of di-m-tolydiphenylbiphenyldiamine dispersed in a polycarbonate, coated on a generator layer, generally made from trigonal selenium. The grounding layer is typically made from a titanium coated Mylar (a trademark of E.I. duPont de Nemours and Company (UK) Ltd.)(a polyester film). Of course, other suitable photoconductive materials, ground layers, and anti-curl substrates may also be employed.

Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under a desired tension. Drive roller 20 is rotated by a motor (not shown) coupled thereto by any suitable means such as a drive belt. Thus, the rotational movement of roller 20 advances belt 10 in the direction of arrow 12 to advance successive portions of the photoconductive surface sequentially through the various processing stations disposed about the path of movement thereof.

Initially, a portion of photoconductive belt 10 passes through charging station A whereat two corona generating devices, indicated generally by reference numerals 22 and 24, charge photoconductive belt 10 to a relatively high, substantially uniform potential. This dual or "split" charging system is designed so that corona generating device 22 places all of the required charge on photoconductive belt 10 while corona generating device 24 acts as a leveling device to provide a uniform charge across the surface of the belt. Corona generating device 24 also fills in any areas which may have been missed by corona generating device 22.

Next, the charged portion of photoconductive belt 10 is advanced through imaging station B, whereat an original document to be reproduced is placed on platen 28 for being imaged onto the charged photoconductive belt 10. Imaging of the document is achieved by two flash lamps 30 mounted in the optics cavity for illuminating the document on platen 28. Light rays are reflected from the document and transmitted through lens 32 which focuses the light image of the original document onto the charged portion of the photoconductive surface of belt 10 to selectively dissipate the charge thereon. This records an electrostatic latent image on photoconductive belt 10 corresponding to the informational areas contained within the original document.

The printing machine includes an annotation system 101 which will be described in greater detail with respect to FIGS. 1–3. The annotation system includes an occluding device assembly 110 and a light emitting source 120 such as, for example, an LED array is provided. The occluder device mask operates to the photoreceptor in a predetermined area so that the charge on the photoreceptor in that area is not dissipated by the light image of the original document. Subsequently, the light emitting source records a separate, additional image on the photoreceptor. This annotation system is located essentially just in advance of the processing station that applies developing material to the charged image pattern on the photoconductive belt surface 10, the so-called development station, generally indicated by reference letter C. The general operation of an annotation system is described in U.S. Pat. No. 5,521,675 to Poplawski, the relevant portions thereof being incorporated herein by reference.

It is noted that, at imaging station B, a document handling unit, indicated generally by reference numeral 26, may be positioned over platen 28 of the printing machine. The document handling unit 26 sequentially feeds documents from a stack of documents placed in a document stacking and holding tray such that the original documents to be copied are loaded face up into the document tray on top of the document handling unit. Using this system, a document feeder, located below the tray, feeds the bottom document in the stack to a pair of rollers for advancing the document onto platen 28 by means of a belt transport which is lowered onto the platen with the original document being interposed between the platen and the belt transport. When the original document is properly positioned on platen 28, the document is imaged and the original document is returned to the document tray from platen 28 by either of two paths. If a simplex copy is being made or if this is the first pass of a duplex copy, the original document is returned to the document tray via a simplex path. Conversely, if this is the inversion pass of a duplex copy, then the original document is returned to the document tray through a duplex path.

At development station C, a magnetic brush developer housing, indicated generally by the reference numeral 34, is provided, having three developer rolls, indicated generally by the reference numerals 36, 38 and 40. A paddle wheel 42 picks up developer material, generally comprising triboelectrically charged carrier granules and toner particles, in the developer housing 34 for delivering the developer material to the developer rolls. When the developer material reaches rolls 36 and 38, it is magnetically split between the rolls with approximately half of the developer material being delivered to each roll. Photoconductive belt 10 is situated adjacent rolls 36 and 38 for attracting toner particles from an extended development zone formed thereby. Developer roll 40 is a cleanup roll and magnetic roll 44 is a carrier granule removal device adapted to remove any carrier granules adhering to belt 10. Thus, rolls 36 and 38 advance developer material into contact with the electrostatic latent image, which may include the additional image information provided by the annotation system, whereby the latent image attracts toner particles from the carrier granules of the developer material to form a toner powder image on the photoconductive surface of belt 10.

After development, belt 10 then advances the toner powder image to transfer station D, where a sheet of support material or a copy sheet (not shown) is moved into contact with the toner powder image. A corona generating device 46 charges the copy sheet to a proper potential so that the sheet is electrostatically secured or "tacked" to belt 10. Corona generating device 46 also provides electrostatic fields for attracting the toner image from the photoreceptor belt 10 to the copy sheet. Thus, the transfer station operates to induce contact between the developed image on belt 10 and the sheet of support material for transfer of the toner image thereto.

A high capacity feeder, indicated generally by the reference numeral 82, is the primary source of copy sheets. High capacity feeder 82 includes a tray 84 supported on an elevator 86. The elevator is driven by a bi-directional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D.

After the developed image is transferred to the copy sheet, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to fusing station E.

Fusing station E includes a fuser assembly, indicated generally by the reference numeral 52, for permanently affixing the transferred toner powder image to the copy sheet. Preferably, fuser assembly 52 includes a heated fuser roller 54 and a pressure roller 56. The developed copy sheet is transported to the fusing station with the powder image on the copy sheet contacting fuser roller 54. The pressure roller 56 abuts the fuser roller 54 to provide the necessary pressure to fix the toner powder image to the copy sheet. In this exemplary fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl as well as any other curls or wrinkles which may have been introduced into the copy sheet. The copy sheet is then advanced, via forwarding roller pairs 60 to duplex turn roll 62. A duplex solenoid gate 64 selectively guides the copy sheet to finishing station F or to duplex tray 66. In the finishing station, the copy sheets are collected in sets and the copy sheets of each set can be stapled or glued together.

Alternatively, a solenoid activated gate 64 can be used to divert the sheet into duplex tray 66, providing intermediate storage for those sheets that have been printed on one side and on which an image will be subsequently printed on the second, opposed side thereof, i.e. the sheets being duplexed. Duplex sheets are typically stacked in duplex tray 66 face down in a configuration, one on top of another, in the order in which they are copied. In order to complete duplex copying, the simplex sheets in tray 66 are fed, in seriatim, by a bottom feeder 68, from tray 66 back to transfer station D, via conveyor 70 and rollers 72. These sheets are then transported back to the transfer station for transfer of a toner powder image to the opposite sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets may also be fed to transfer station D from a secondary tray 74 or an auxiliary tray 78 for providing additional sheet capacity on special types of copy sheets. Each tray includes an elevator driven by a bi-directional AC motor and a controller having the ability to drive the tray up or down. When the tray is in the down position, stacks of copy sheets are loaded thereon or unloaded therefrom. In the up position, successive copy sheets may be dispersed therefrom by a sheet feeder 76. Sheet feeder 76 may comprise a friction retard feeder, as shown schematically in FIG. 3, utilizing a feed belt and take-away rolls to advance successive copy sheets to transport 70 which, in turn, advances the sheets to rolls 72 and then to transfer station D. It will be recognized that secondary tray 74 and auxiliary tray 78 are supplemental sources of copy sheets for providing machine adaptability and flexibility for particular print jobs.

Invariably, after the copy sheet is separated from photoconductive belt 10, some residual particles remain bonded thereto. Thus, after transfer, photoconductive belt 10 passes beneath yet another corona generating device 94 which charges the residual toner particles to the proper polarity for breaking the bond between the toner particles and the belt. Thereafter, a precharge erase lamp (not shown), located inside the loop formed by photoconductive belt 10, discharges the photoconductive belt in preparation for the next charging cycle. Residual particles are removed from the photoconductive surface at cleaning station G which may include an electrically biased cleaner brush 96 and waste and reclaim de-toning rolls 98 and 100, as illustrated. The reclaim roll 98 may be electrically biased to a polarity opposite that of the cleaner roll 96 so as to remove toner particles therefrom while the waste roll 100 may also be electrically biased positively relative to the reclaim roll 98 so as to remove paper debris and wrong sign toner particles. The toner particles on the reclaim roll 98 are scraped off and deposited in a reclaim auger (not shown), where they are transported out of the rear of cleaning station G.

The various machine functions are regulated by a controller (not shown) which is preferably a programmable microprocessor designed to communicate and manage all of the machine functions hereinbefore described. The controller controls all the printer steps and functions as described herein, including imaging onto the photoreceptor, paper delivery, xerographic functions associated with developing and transferring the developed image onto the paper, various processing functions provided by finishing station F, and operation of the annotation system of the present invention, including the selective positioning of the occluding device 110 and the light emitting source 120, as well as control of the light emitting source 120. The printer controller initiates a sequencing schedule which is highly efficient in monitoring the status of a series of successive print jobs which are to be printed and finished in a consecutive fashion. Conventional sheet path sensors or switches may be utilized to keep track of the position of documents and the sheets in the machine. In addition, the controller regulates the various positions of gates and switching mechanisms, depending upon the mode of operation selected. Among other things, the controller may provide time delays, jam indications and fault actuation. Selective operation of all of the exemplary systems described hereinabove may be accomplished by a conventional user interface control having the capability to provide operator input through a console or graphic user interface device.

The foregoing description should be sufficient for the purposes of the present disclosure for patent to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

Figure 4:
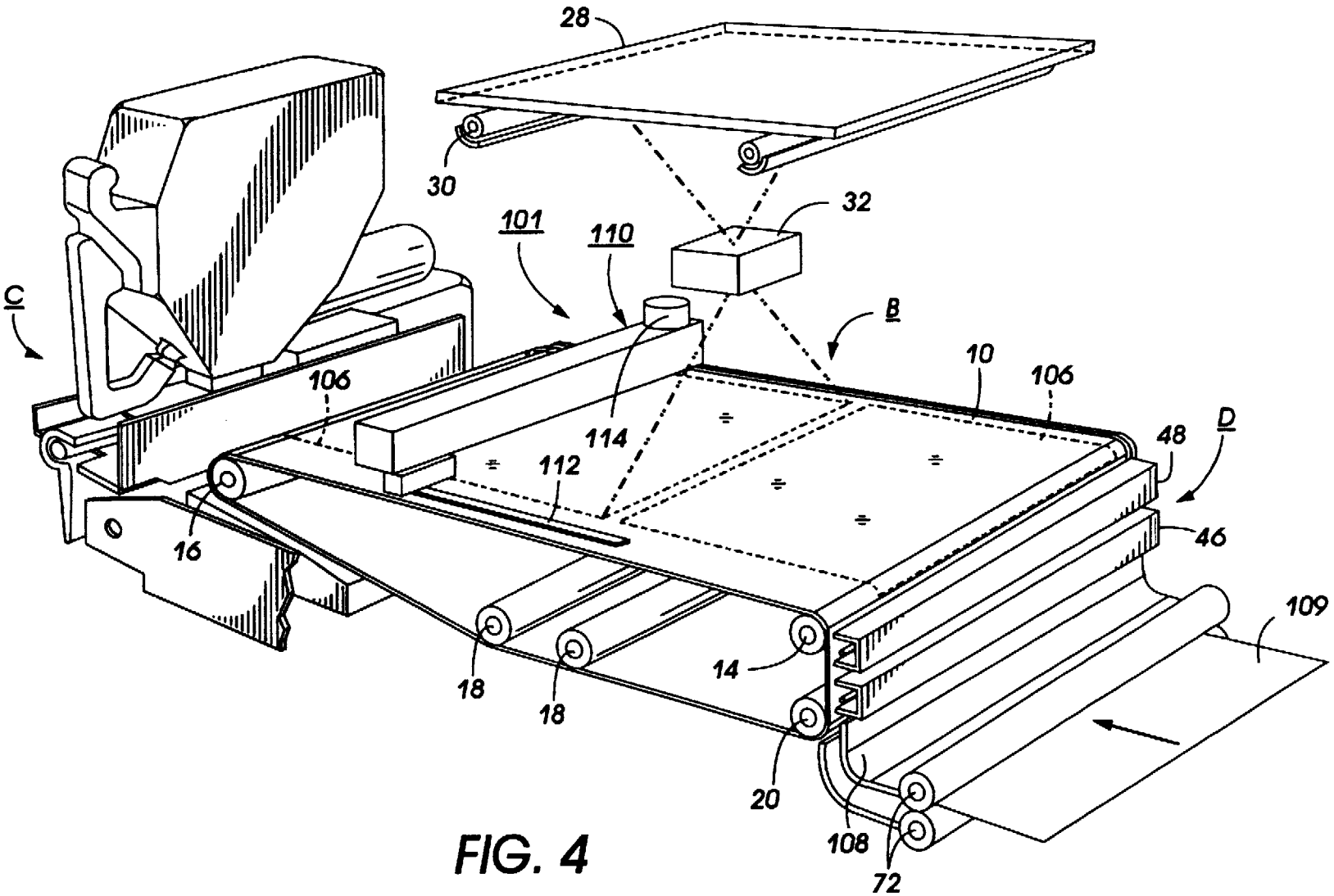
FIG. 4 is a perspective view of an illustrative photoreceptor belt showing the occluder bar assembly of FIG. 1.

Referring now to FIG. 4, wherein further details of the annotation system and, in particular, the occluding device assembly of the present invention are shown. A plurality of latent image areas, or so-called pitches 106, are shown in phantom on the surface of the photoreceptor belt 10, wherein each pitch corresponds to an image area produced by imaging station B (see FIG. 5). A copy sheet, identified by reference numeral 109 is shown entering the input side of the transfer station D, comprising transfer corotron 46 and detack corotron 48 situated in a spaced relationship to photoreceptor belt 10. The copy sheet 109 is engaged in a feed nip comprising a pair of rollers 72 operative to transport the copy sheet 109 to the transfer station through chute 108. The copy sheet is subsequently advanced into contact with photoreceptor belt 10, where it will meet the belt 10 in synchronization with a developed latent image area or pitch thereon.

Figure 2:
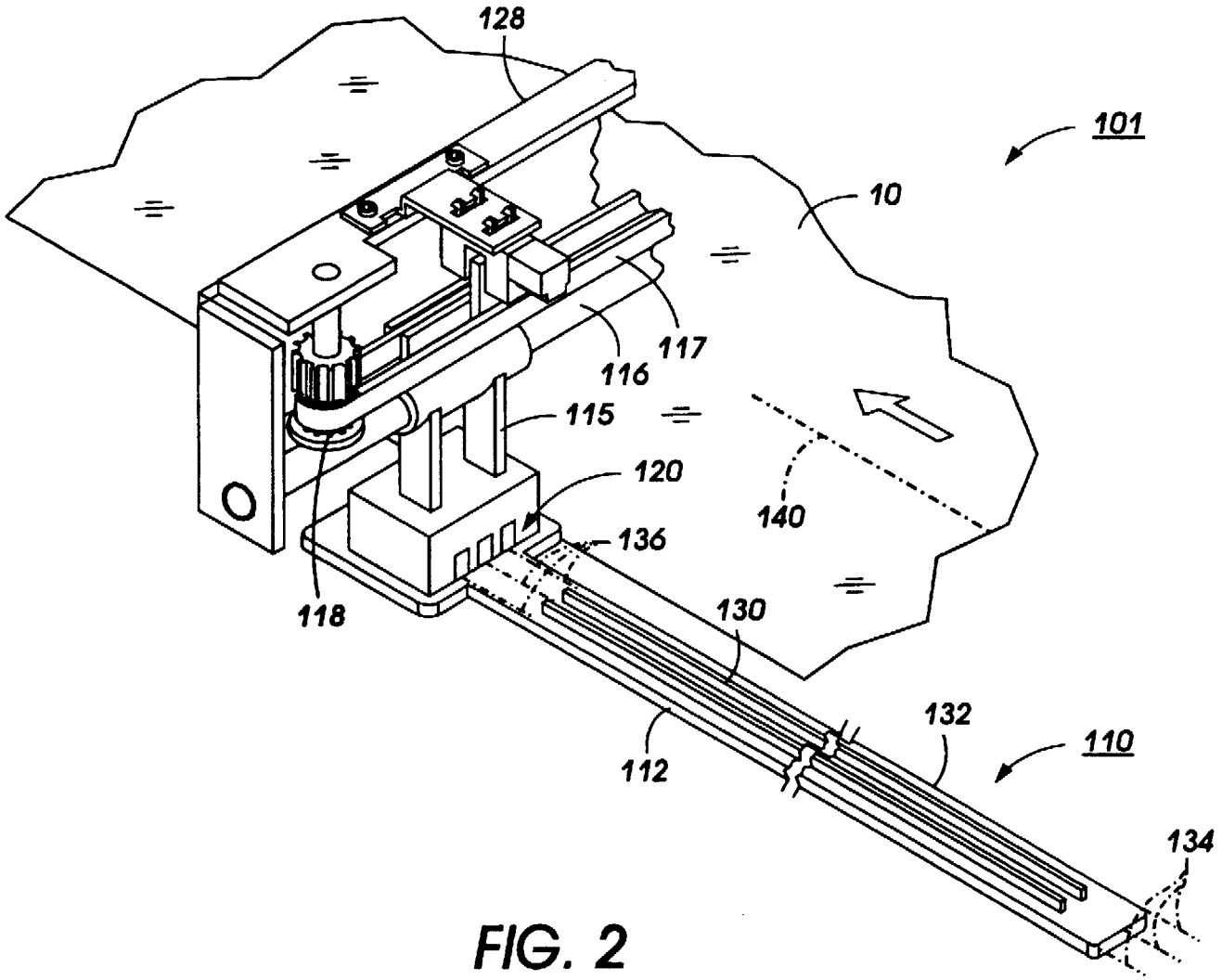
FIG. 2 is a partial perspective view of the occluder bar assembly of FIG. 1 showing the integrally mounted occluder bar and light emitting source.
Figure 3:
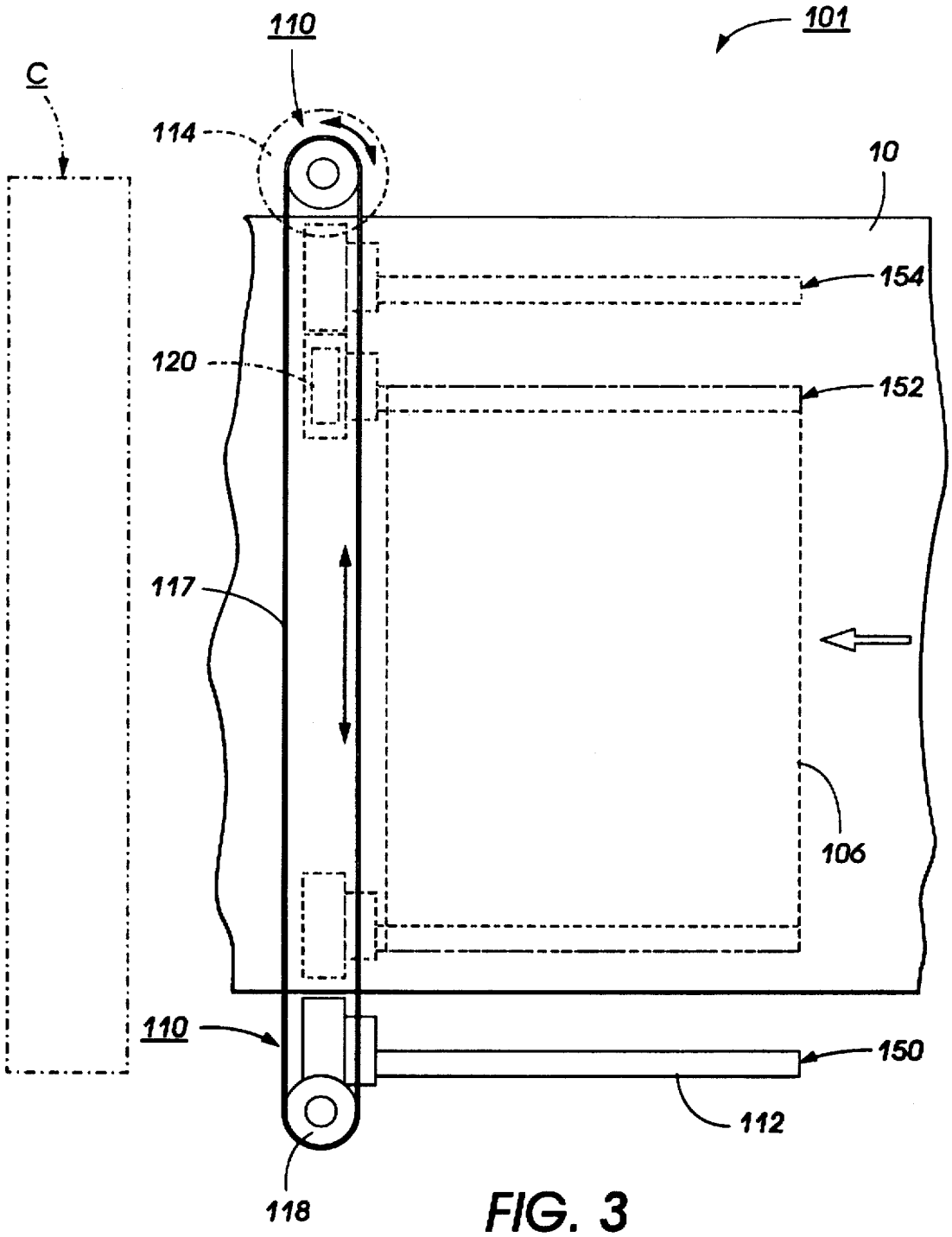
FIG. 3 is a top plan view of the occluder bar assembly of FIG. 1.

The annotation system 101 of the present invention is also shown in schematic form in FIG. 3, located essentially just in advance of the development area C at which toner is applied to the charged image pattern on the surface of the photoconductive belt 10. The annotation system 101 includes an occluding device assembly 110, described in greater detail hereinbelow with reference to FIGS. 1 and 2, comprising an occluder bar 112 and a drive motor 114, a light emitting source 120 which preferably takes the from of an LED array, and a programmable control means (not shown), coupled to the annotation system for providing selective control thereof.

Referring to FIG. 2, the occluder bar 112 and the light emitting source 120 are shown in greater detail. The occluder bar 112 may include transparent portions 130 and opaque portions 132. According to the present invention, the LED bar 120 is mounted with the occluder bar 112 and so aligned therewith such that centerlines 134 of the opaque portions of the occluder bar 112 are in alignment with centerlines 136 of the imaging heads of the LED bar 120, axes 134 and 136 being parallel to axis 140 of travel of the photoreceptor belt 10. Since the LED bar 120 and the occluder bar 112 are both mounted on a support carriage 115 and both travel therewith, the centerlines 134 of the occluder bar 112 remain in alignment with the centerlines 136 of the LED bar 120 throughout the travel of the support carriage 115 along frame 128.

The occluder bar 112 is designed to pass less than 100% of the light emanating from a strobe bulb of the type used in the electrostatographic printing machine for masking the photoreceptor to define a predetermined region of retained charge thereon.

In operation, referring to FIG. 4, the annotation system is actuated as an operator selectable feature via a graphic user interface (not shown) coupled to the previously described controller in the form of a programmable microprocessor. The occluder bar 112 is automatically advanced via motor 114 to a selected position so as to shield or mask a predetermined region in an image pitch 106 on the belt 10 when the discharge light 30 of the imaging system B of the machine reflects the image producing light pattern from the original document platen 28 onto the belt surface. This masking process prevents the discharge of the belt 10 by the discharge light 30 for creating a charged region on the photoconductive belt 10 in an area normally discharged by imaging system. Typically, this predetermined region corresponds to an area where images from the original document do not appear, such as the top or bottom margin of the document.

Since the LED bar 120 travels with the occluder bar 112, the occluder bar 112 and the predetermined region of retained charge created thereby, are always positioned in alignment with an LED array 120. Therefore, as the belt surface passes under the LED array 120 a number, letter or alphanumeric character is exposed to the charged area proscribed by the occluder bar 112. If white on black development is desired, the LED array 120 is illuminated in the image of the character and only the character pattern area is discharged. Thus, toner will be picked-up in the entire predetermined region. Conversely, if black on white is desired the entire predetermined region will be illuminated by the LED matrix except for the character pattern area such that toner will only be picked-up by the character area. In this printing mode, margin LEDs may also be provided and continuously illuminated for erasing the predetermined retained charge area extending beyond the characters produced by LED array 120.

Referring again to FIGS. 1 and 2, the particular features of the occluding device assembly 110, and in particular, the jointly traveling LED bar 120 and occluder bar 112 of the present invention will be described in greater detail. As seen in FIG. 2, the occluding device assembly 110 is comprised of the occluder bar 112, the LED bar 120, the support carriage 115 on which the occluder bar 112 and the LED bar 120 are mounted, a support member, for example in the form of a shaft 116 to which the support carriage 115 is movably mounted and a linear drive system including D.C. motor 114 and a drive mechanism, for example in the form of a drive belt 117, for advancing the occluder bar 112 and the LED bar 120 to various positions with respect to an image pitch on P/R belt 10. The various positions may include a PARK position 150 to the side of the belt surface (as shown is FIG. 2) for storage of the occluder bar when the annotation system is not utilized, and two locations 152 and 154 adjacent to specific areas on the belt surface appropriate for use with 11 inch copy paper and 14 inch copy paper, respectively (as shown in phantom in FIG. 3).

Referring again to FIGS. 1 and 2, the D.C. motor 114 is connected to the drive belt 117 via a pair of drive gears 118 situated at opposite ends of the drive belt 117 for allowing the belt to travel along a curvilinear path therebetween. The motor 114, belt 117, gears 118 and shaft 116 are all supported by frame 128. The drive belt 117, in turn, is coupled to the support carriage 115, for providing linear transport thereto along the length of support shaft 116. As can be seen, the motor 114 is provided with conductors 156 for enabling energization of the D.C. motor in response to a signal from the controller or other input. A position sensor 108 of a type well known in the art is also provided and is arranged to align with a position tab 109 protruding from the support carriage 115 for detecting a "home position" to properly locate the occluder bar 112 and LED bar 120. As best seen in FIG. 1, the position tab 109 extends into a slot in the position sensor 108 for providing an indication that the support carriage 115, and as a result, the occluder bar 112 is in the PARK position, for example.

By providing an annotation system including a drive apparatus that simultaneously positions the occluder bar and the light emitting source, an annotation system may be provided that provides for titles and numbers to be placed anywhere along the length of a copy sheet.

By providing an annotation system including a drive apparatus having the occluder bar and light emitting source mounted with each other and traveling together therewith, an annotation system may be provided that permits the placing of titles and numbers anywhere along the length of the copy sheet.

By providing an annotation system with a light emitting source and an occluder bar which travel together along the length of the bar, a single small LED print bar may be utilized to position text and titles anywhere along the copy sheet.

By providing an annotation system including a light emitting source and an occluder which travel together, a full length LED print bar may be replaced by a small LED print bar at a much reduced cost.

By providing an annotation system including a light emitting source and an occluder bar which are mounted and travel together, an annotation system may be provided with universal placement of titles and numbers at a reduced cost.

It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An annotation system for automatically recording additional image information on an image bearing member, comprising:

a drive apparatus;

a housing slidably attached to said drive apparatus;

a light emitting source for producing a light image of the additional image information mounted in said housing; and an occluder bar for masking the image bearing member in a predetermined region to allow for the additional image information to be recorded thereon, said occluder bar mounted to said housing and extending therefrom, the light image passing directly from said light emitting source to the image bearing member, said drive apparatus simultaneously selectively positioning said occluder bar and said light emitting source with respect to an image area on the image bearing member, wherein said housing defines an aperture in the lower portion thereof, said occluder bar defining an opening therethrough, said light emitting source being positioned with respect to the aperture and the opening so that the light image passes through the aperture and the opening directly from said light emitting source to the image bearing member.

2. The annotation system of claim 1, wherein said occluder bar is substantially planar, said occluder bar having a first end thereof including an aperture therethrough, the first end of said occluder being positioned below said housing.

3. An annotation system for automatically recording additional image information on an image bearing member, comprising:

a drive apparatus;

a housing slidably attached to said drive apparatus;

a light emitting source for producing a light image of the additional image information mounted in said housing; and an occluder bar for masking the image bearing member in a predetermined region to allow for the additional image information to be recorded thereon, said occluder bar mounted to said housing and extending therefrom, the light image passing directly from said light emitting source to the image bearing member, said drive apparatus simultaneously selectively positioning said occluder bar and said light emitting source with respect to an image area on the image bearing member, wherein said housing includes a cavity therein for mounting said light emitting source, said housing defining a passageway therein extending from the cavity to a periphery thereof, said passageway being in alignment with the light emitting source such that the light image may pass through the passageway directly from said light emitting source to the image bearing member, wherein said light emitting source comprises an LED array, said occluder bar defining a slot therethrough, said slot of said occluder bar being in alignment with the passageway of the housing such that the light image may pass through the passageway and the slot directly from said light emitting source to the image bearing member.

4. An electrostatographic printing machine for reproducing a copy of an original document, the copy including additional image information thereon, comprising:

a photoconductive member;

means for charging at least a portion of said photoconductive member to a substantially uniform potential;

means for selectively illuminating the charged portion of said photoconductive member to selectively discharge the charged portion of said photoconductive member such that an electrostatic latent image corresponding substantially to the original document being reproduced is recorded thereon; and an annotation system for automatically recording additional image information on said photoconductive member, including an occluding device assembly, including a drive apparatus, a housing slidably attached to said drive apparatus, a light emitting source for producing a light image of the additional image information mounted in said housing, and an occluder bar for masking the photoconductive member in a predetermined region to allow for the additional image information to be recorded thereon, said occluder bar mounted to said housing and extending therefrom, said light image passing directly from said light emitting source to the photoconductive member, said drive apparatus simultaneously selectively positioning said occluder bar and said light emitting source with respect to an image area on the photoconductive member, wherein said housing defines an aperture in the lower portion thereof, said occluder bar defining an opening therethrough, said light emitting source being positioned with respect to the aperture and the opening so that the light image passes through the aperture and the opening directly from said light emitting source to the photoconductive member.

5. The annotation system of claim 4, wherein said occluder bar is substantially planar, said occluder bar having a first end thereof including an aperture therethorough, the first end of said occluder bar being positioned below said housing.

6. An electrostatographic printing machine for reproducing a copy of an original document, the copy including additional image information thereon, comprising:

a photoconductive member;

means for charging at least a portion of said photoconductive member to a substantially uniform potential;

means for selectively illuminating the charged portion of said photoconductive member to selectively discharge the charged portion of said photoconductive member such that an electrostatic latent image corresponding substantially to the original document being reproduced is recorded thereon; and an annotation system for automatically recording additional image information on said photoconductive member, including an occluding device assembly, including a drive apparatus, a housing slidably attached to said drive apparatus, a light emitting source for producing a light image of the additional image information mounted in said housing, and an occluder bar for masking the photoconductive member in a predetermined region to allow for the additional image information to be recorded thereon, said occluder bar mounted to said housing and extending therefrom, said light image passing directly from said light emitting source to the photoconductive member, said drive apparatus simultaneously selectively positioning said occluder bar and said light emitting source with respect to an image area on the photoconductive member, wherein said housing includes a cavity therein for mounting said light emitting source, said housing defining a passageway therein extending from the cavity to a periphery thereof, said passageway being in alignment with the light emitting source such that the light image may pass through the passageway directly from said light emitting source to the photoconductive member, wherein said light emitting source comprises an LED array, said occluder bar defining a slot therethrough, said slot of said occluder bar being in alignment with the passageway of the housing such that the light image may pass through the passageway and the slot directly from said light emitting source to the photoconductive member.

* * * * *